US005742693A

United States Patent [19]

Elko

[11] Patent Number: 5,742,693

[45] Date of Patent: Apr. 21, 1998

[54] IMAGE-DERIVED SECOND-ORDER DIRECTIONAL MICROPHONES WITH FINITE BAFFLE

[75] Inventor: Gary Wayne Elko, Summit, N.J.

[73] Assignee: Lucent Technologies Inc., Murray Hill, N.J.

[21] Appl. No.: 580,701

[22] Filed: Dec. 29, 1995

[51] Int. Cl.[6] ..... H04R 3/00

[52] U.S. Cl. ..... 381/92; 381/91; 381/122; 381/160; 381/169

[58] Field of Search ..... 381/92, 94, 91, 381/169, 122, 160

[56] References Cited

U.S. PATENT DOCUMENTS 2,544,536 3/1951 Kettler .

4,742,548 5/1988 Sessler et al. ..... 381/92

4,965,775 10/1990 Elko et al. ..... 367/119

*Primary Examiner*—Forester W. Isen

[57] ABSTRACT

An acoustic transducer including an acoustical reflecting surface of a finite dimension and at least one sensor having an output which produces a first-order differential response pattern. The sensor is located proximate to the reflecting surface, wherein acoustical waves propagating from the reflecting surface, acoustically interact with the sensor to produce a second-order differential response pattern at the output of the sensor at a predetermined frequency. The second-order differential response pattern at the output of the sensor occurs at the predetermined frequency when the finite dimension of the reflecting surface is at least one-half of an acoustic wavelength.

22 Claims, 9 Drawing Sheets

IMAGE-DERIVED SECOND-ORDER DIRECTIONAL MICROPHONES WITH FINITE BAFFLE

FIELD OF INVENTION

The present invention relates to directional microphones and acoustic sensors.

BACKGROUND OF THE INVENTION

There are many applications where it is desirable to employ acoustic transducers with directional characteristics. Such applications include speakerphone telephony, speech recognition and hands-free calling from automobiles. Unidirectional microphones are one of the more popular acoustic transducers is use today. Most of these microphones are of the first-order differential type which generally exhibit directivity factors ranging up to four.

Improved directivity indices up to nine dB have been achieved with second-order differential microphones. Early second-order differential microphone designs, however, displayed problems which related to their complicated design and poor signal to noise ratio at low frequencies when compared with first-order designs. These problems have tended to limit the utilization of second-order differential microphones. More recent second-order differential unidirectional microphone designs using multiple commercially available sensors for conference telephony and hands-free calling from automobiles have been described in an article entitled UNIDIRECTIONAL, SECOND-ORDER-DIFFERENTIAL MICROPHONE by J. E. West et al., *J. Acoust. Soc. America,* Vol 86, (1989), pp. 2063–2066 and in U.S. Pat. No. 4,742,548, issued May 3, 1988 to J. E. West et al. In both the article and the patent, a matching pair of first-order differential sensors, spaced a small distance from each other and added with proper phase and delay, were utilized to form a second-order differential unidirectional microphone. This type of microphone was small in size and had a relatively simple construction as compared to earlier designs. Further, the microphone demonstrated frequency independent directional response and were generally designed to operate either freely suspended above or placed on a table top. Such microphones can exhibit toroidal and bipolar directional characteristics. The polar characteristics of such microphones are dependent on the close matching of both the amplitude and the phase between the sensors over the frequency range of interest. The second-order differential microphone design described above represents an advancement over earlier designs. However, the relative positioning and sensitivity of the two first-order directional elements employed therein can be extremely demanding when two or more second-order differential microphones are to be "matched" or used together, as in an array of such microphones.

In order to avoid the poor signal-to-noise ratio at lower frequencies, complexity and matching problems of second-order differential microphones, image-derived directional microphones have been developed. Such microphones are described in U.S. Pat. No. 4,965,775 entitled IMAGE-DERIVED DIRECTIONAL MICROPHONES, issued on Oct. 23, 1990 to G. W. Elko et al. and assigned to AT&T Bell Laboratories, the assignee herein and in an article entitled IMAGE-DERIVED DIRECTIONAL MICROPHONES by G. W. Elko et al., *J. Acoust. Soc. America,* Vol., 95 (4), 1994, pp. 1991–1997. Both the patent and the article describe image-derived second-order differential microphones having both toroidal and unidirectional characteristics. Such microphones can be mounted directly on an acoustically reflecting wall or on a large reflecting surface that can be placed on or near a wall.

FIGS. 1A and 1B depict the image-derived second-order differential microphones described in the U.S. Pat. No. 4,965,775 and the article by Elko et al. As shown, the image-derived second-order differential microphone can generally consist of either a baffled, single first-order bipolar differential microphone 20 over an infinite reflecting plane or baffle 22 as shown in FIG. 1A or, two subtracted closely-spaced omnidirectional elements p1 and p2 mounted close to an infinite reflecting plane or baffle 24 as shown in FIG. 1B. The microphone arrangement shown in FIG. 1A demonstrated that only one sensor was required to achieve second-order differential and other directional characteristics. Moreover, the image was a perfect match to the real sensor both in frequency and phase.

One problem which plagues the image-derived second-order differential microphones described above involves the implementation of an infinite reflecting plane or baffle. In particular, it has been found that infinite reflecting planes or baffles are not generally attainable in practice.

It is, therefore, an object of the present invention to provide an improved image-derived second-order differential microphone.

SUMMARY OF THE INVENTION

An acoustic transducer comprising an acoustical reflecting surface of a finite dimension and at least one sensor having an output which produces a first-order differential response pattern. The at least one sensor is located proximate to the reflecting surface, wherein acoustical waves propagating from said reflecting surface, acoustically interact with the at least one sensor to produce a second-order differential response pattern at the output of the at least one sensor at a predetermined frequency.

The second-order differential response pattern at the output of the at least one sensor occurs at the predetermined frequency when the finite dimension of the reflecting surface is at least one-half of an acoustic wavelength.

DESCRIPTION OF DRAWINGS

For a detailed understanding of the present invention, reference should be made to the following detailed description taken in conjunction with the accompanying drawings wherein.

DETAILED DESCRIPTION OF EMBODIMENTS

In order to fully understand the image-derived second-order differential microphone of the present invention, it is first necessary to generally understand how the transition from first-order to second-order occurs in an image-derived microphone as is explained below.

Figure 1A:
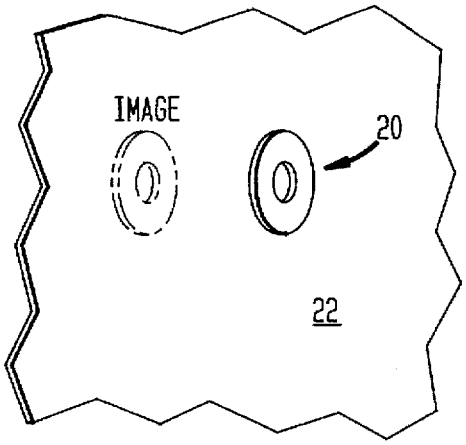
FIG. 1A (PRIOR ART)
FIG. 1A depicts a prior art image-derived second-order differential microphone consisting of a baffled, first-order dipole differential microphone over an infinite reflecting plane.
Figure 1B:
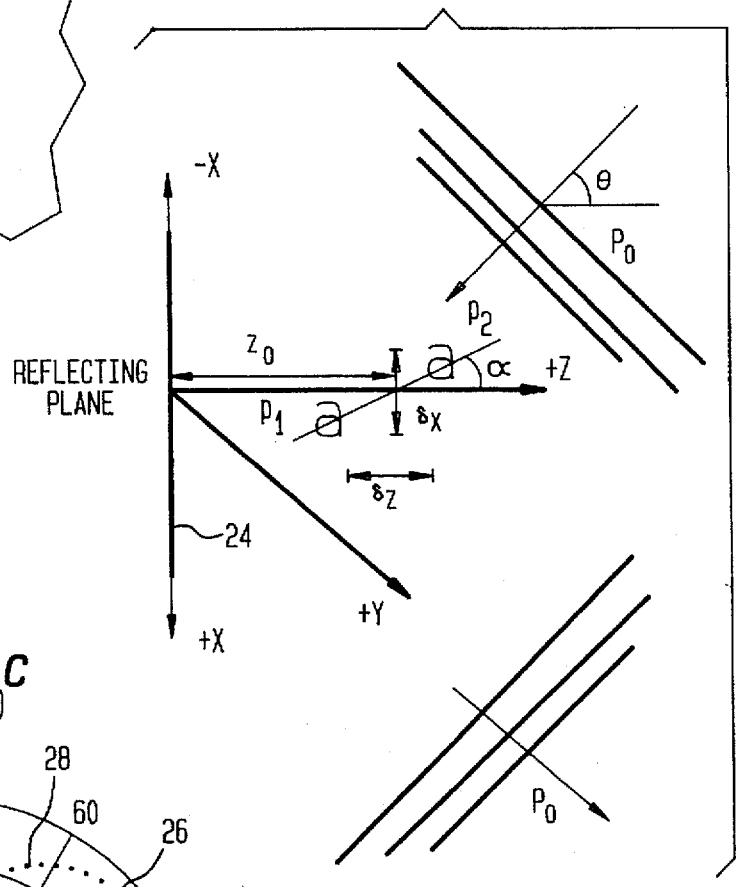
FIG. 1B (PRIOR ART)
FIG. 1B schematically depicts a first-order pressure differential microphone over an infinite reflecting plane.

Referring again to the image-derived second-order differential microphone shown in FIG. 1B, the two closely-space omnidirectional microphones measuring p1 and p2, are located over the infinite reflecting plane 24 at a general angle ∝ with respect to the z-axis and a distance of zo from the reflecting surface that lies in the x-plane. The spacing between the microphones is equal to the squareroot of $\delta_x^2+\delta_z^2$. Note that the coordinate system has been rotated so that the z-axis is oriented in the same direction as shown in FIG. 1A and that the angle θ is relative to the positive z-axis.

For an incident plane-wave of angular frequency w the field can be decompose into incident and reflected fields, $$p_i(t)=P_o\, e^{j(wt+k_x x+k_y y-k_z z)}$$

$$p_r(t)=P_o\, e^{j(wt+k_x x+k_y y+k_z z)} \qquad \text{Equation (1).}$$

where kx, ky, and kz are the components of the wave-vector field and the reflecting plane is at z=0. The total pressure at any location is, $$p_T(t)=p_i(t)+p_r(t)=2\,P_o\cos(k_z z)\, e^{j(wt+k_x x+k_y y)} \qquad \text{Equation (2).}$$

Equation (2) shows that the resulting field has a standing wave in the z-direction and propagating plane wave fields in the x and y-directions. In spherical coordinates kx, ky, and kz can be written as, $$\begin{aligned} kx &= k\cos(\phi)\sin(\theta) \\ ky &= k\sin(\phi)\sin(\theta) \\ kz &= k\cos(\theta) \end{aligned} \qquad \text{Equation 3.}$$

where k is the acoustic wavenumber θ and ϕ are the standard spherical coordinate angles. The pressure difference (p1(t)−p2(t)) between the two microphone elements shown in FIG. 1B is, $$p1(t)-p2(t)=2\,P_o\, e^{j(wt+k_x x_o)}\,[j\cos(k_z z_o)\cos(k_z\delta z)\sin(k_x\delta x)-\sin(k_z z_o)\sin(k_z\delta z)\cos(k_x\delta x)] \qquad \text{Equation (4).}$$

where δz is the component of the displacement vector between the two microphone elements in the z-direction and δx is the component in the x-direction. The position (xo, zo) is the central point between the two microphone elements. For the limiting case where δx=0 (vertical dipole) and $k_z z_o \ll \pi$, and $k_z\delta z \ll \pi$, Equation 5 reduces to, $$p1(t)-p2(t)=2\,P_o k^2 z_o\delta z\cos^2(\theta)e^{j(wt+k_x x_o)} \qquad \text{Equation (5).}$$

Figure 1C:
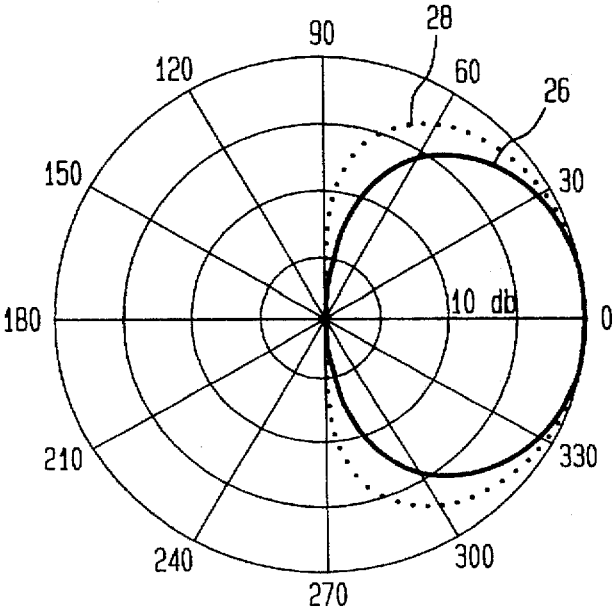
FIG. 1C (PRIOR ART)
FIG. 1C graphically depicts the directional response of the pressure-difference of microphone arrangement of FIG. 1B.

FIG. 1C shows the directional response indicated by a line 26 as given in Equation 5. The front-half directivity for a free-space pressure-difference microphone (cos(θ) directional sensitivity) is also shown as a dotted line 28 for comparison purposes. Equation 5 shows that if the two sensors are closely-spaced with an axis that is orthogonal and close to the reflecting plane (compared to the acoustic wavelength) then a second-order differential array can be realized with two omnidirectional elements. The main parameters that determine the system gain are the two spacings zo and δz as well as the $w^2$ frequency dependence. Note that w=ck, where c is the speed of sound propagation. The image-derived microphone can also be realized by using an acoustic velocity microphone or a pressure-difference microphone (single diaphragm). A description and analysis of this realization can be found in the earlier mentioned article entitled IMAGE-DERIVED DIRECTIONAL MICROPHONES by G. W. Elko et al. Essentially, the use of velocity or single-diaphragm pressure-difference transducers is equivalent to the two-element pressure-difference realization in the limit as the distance between the elements approaches zero. A further understanding of image-derived second order differential microphones can be had by referring to the earlier mentioned U.S. Pat. No. 4,965,775 by G. W. Elko et al., the entire disclosure of which is incorporated herein by reference.

Figure 2A:
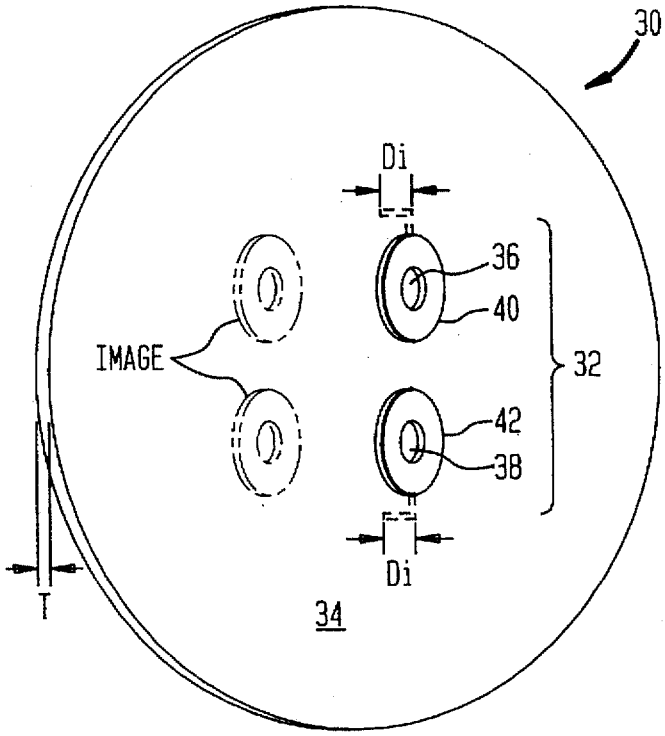
FIG. 2A depicts a first embodiment of an image-derived second-order differential microphone according to the present invention.
Figure 2B:
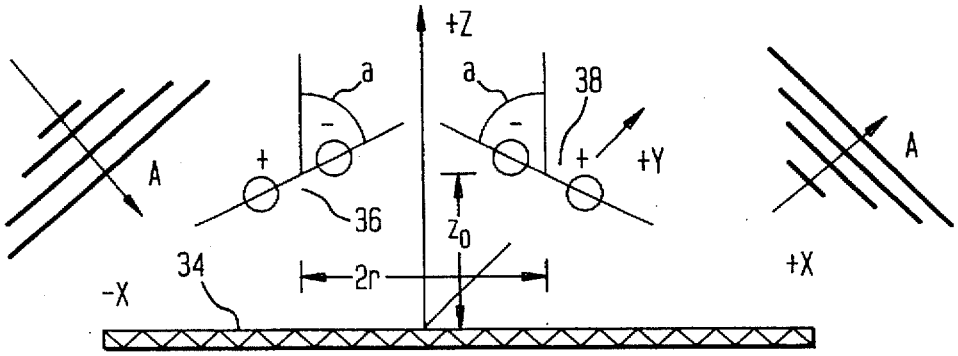
FIG. 2B schematically depicts the microphone shown in FIG. 2B.

Referring now to FIGS. 2A–2B, a first embodiment of an image-derived second-order differential microphone according to the present invention is shown and denoted by the numeral 30. The microphone 30 generally includes a microphone array 32 mounted at a predetermined distance D1 from a finite acoustical reflecting plane or baffle 34. The microphone array 32 consists of a pair of spaced apart phase-matched, first-order differential sensors 36 and 38. Each sensor can be sealing attached to an optional annular shaped sensor baffle 40, 42 as shown, for increased acoustical sensitivity. Such microphone arrays are well known in the art and can be obtained commercially from various manufactures. As can be seen in FIG. 2A, the finite baffle 34 is embodied as a circular disk of a finite thickness T, although the finite baffle 34 can take on other geometries as will described later. The surface of each sensor 36, 38 (including the optional sensor baffle) is oriented parallel to the surface of the finite baffle 34 with the bidirectional axis of each sensor 36, 38 being rotated +−45° to the finite baffle as shown schematically in FIG. 2B (this is similar to the arrangement shown in FIG. 1B and described in U.S. Pat. No. 4,965,775).

Figure 2C:
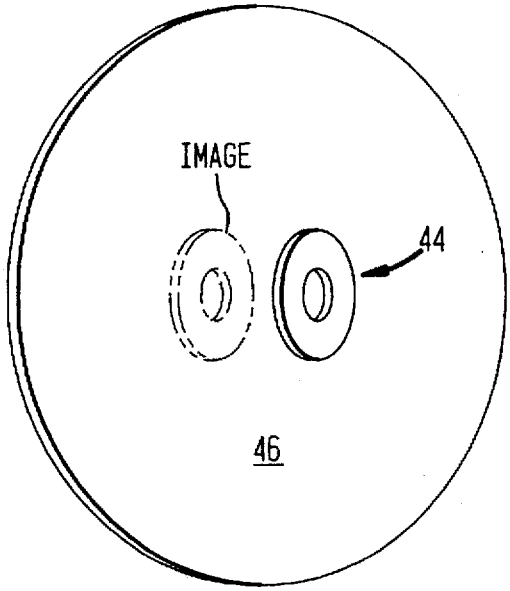
FIG. 2C depicts a second embodiment of the image-derived second-order differential microphone of the present invention.

FIG. 2C depicts a second embodiment of the image-derived second-order microphone of the present invention implemented with a single first-order differential sensor 44 similar to the one described in U.S. Pat. No. 4,965,775. As shown, the sensor 44 is centrally located over a circular disk baffle 46 similar to the baffle shown in FIG. 2A. It should be understood, that the image-derived second-order microphone of the present invention can also be implemented with a line array of multiple sensors (not shown) as described in U.S. Pat. No. 4,965,775.

Figure 2D:
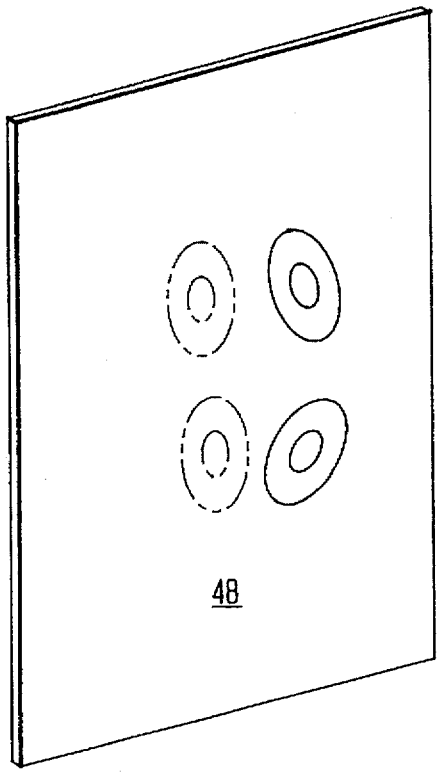
FIG. 2D depicts a third embodiment of the the image-derived second-order differential microphone of the present invention.

FIG. 2D depicts a third embodiment of the image-derived second-order microphone of the present invention having a finite baffle 48 configured as a rectangular plate.

In every embodiment of the present invention, the finite baffle is dimensioned to be at least one-half the acoustic wavelength in order to attain a second-order response at a given frequency and more preferably, larger than one-half the acoustic wavelength. Further, the microphone assembly is preferably positioned over the center of the finite baffle or equivalently, as far as possible from the edge of finite baffle, in order to narrow the transition region at which the microphone goes from first-order to second-order as will be explained later.

Figure 3:
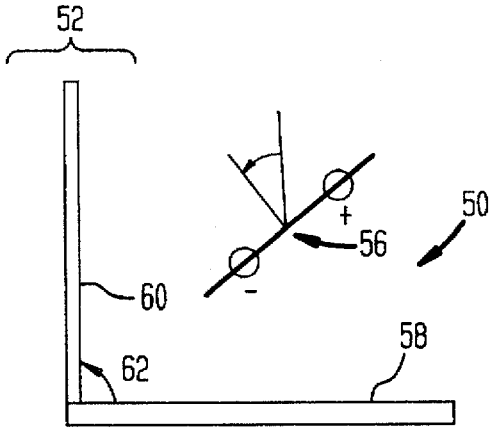
FIG. 3 depicts a fourth embodiment of the image-derived second-order differential microphone of the present invention.

FIG. 3 depicts a fourth embodiment of an image-derived second-order differential microphone according to the present invention, denoted by the numeral 50. The image-derived second order differential microphone includes a microphone 52 consisting of a first-order differential sensor 56 which is similar to the sensors described in FIGS. 2A–2B. The sensor 56 however, is oriented at an edge of two intersecting finite reflecting planes or baffles 58 and 60. The reflection in the (vertical) baffle 60 resulting from the included angle 62 (90 degrees) provides a toroidal response. Since the reflecting baffles 58 and 60 are finite, there is a diffracted component such that the microphone 50 essentially reverts to first-order as seen with the flat finite reflecting baffle of the microphone shown in FIGS. 2A–2B. The image-derived second-order differential microphone of the fourth embodiment provides the advantage of a cosine-squared directivity along the axis defined by the intersection line of the two finite baffles 58 and 60. Further, the directivity along the orthogonal direction along the microphone dipole axis can be varied by changing the included angle 62 between the intersecting surfaces of the finite baffles 58 and 60. This feature is especially useful in wall mounted applications where it may be desirable to slightly reduce the directional characteristics of the cosine-squared. As with the earlier described embodiments of the present invention, each one of the finite baffles 58 and 60 is dimensioned to be at least one-half the acoustic wavelength in order to attain a second-order response at a given frequency and more preferably, larger than one-half the acoustic wavelength.

The image-derived second-order differential microphone of the present invention provides many advantages. For example, in speakerphone telephony applications as well as speech recognition, it is desirable to exclude the signal coming out of the loudspeaker and pickup the desired speech source in front of the microphone. The image-derived second-order differential microphone of the present invention accomplishes this by providing a null plane along the reflecting plane of the finite baffle which substantially prevents the far end signal (the signal coming out of the loudspeaker) from going back to the far end via coupling into the near end of the microphone.

In the discussion which follows, the effects of the finite baffle employed in the image-derived second-order differential microphone of the present invention will be shown both computationally and experimentally.

Figure 4:
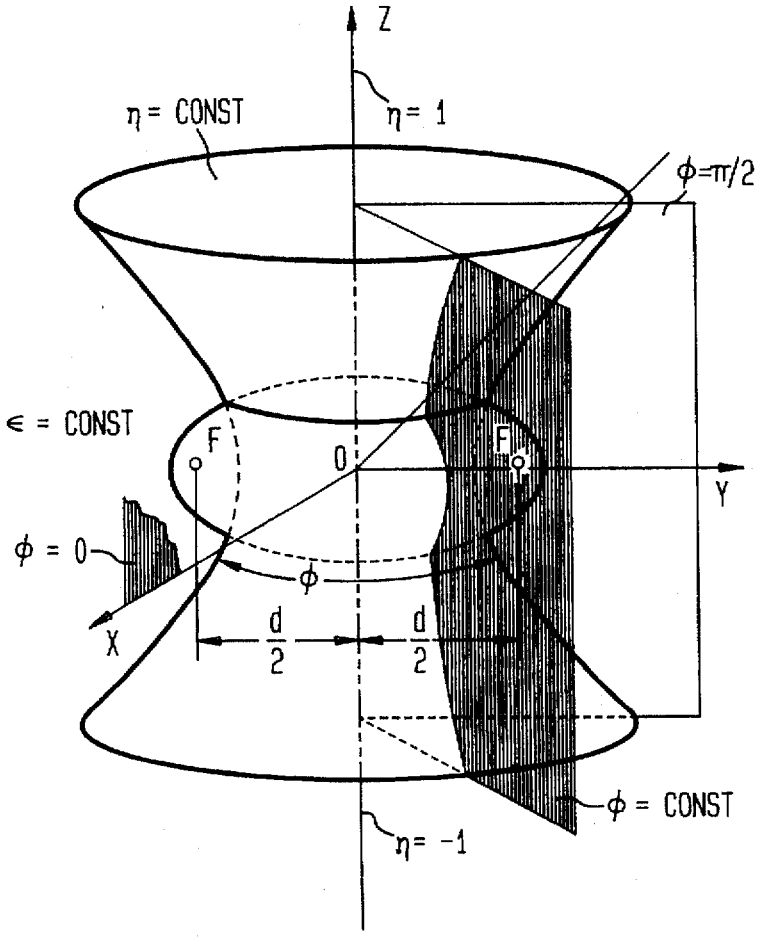
FIG. 4 graphically illustrates three orthogonal surfaces which determine a point in oblate spheroidal space.

In order to computationally demonstrate the effects of the finite baffle, a closed-form analytical solution for the scattering of acoustic waves from a circular disk baffle (such as described above) was implemented. The linear acoustic pressure field must satisfy the Helmholtz wave equation:

$$\nabla^2 p + k^2 p = 0 \qquad \text{Equation (6).}$$

where $\nabla^2$ is the Laplace operator. There are an infinite number of different solutions to an equation of the type of Equation 6. One standard solution is to choose a separable coordinate system that fits the problem at hand. The oblate spheroidal coordinate system is a natural candidate as there is a continuous transformation of this system to that of the disk. FIG. 4 shows the three orthogonal surfaces of the oblate spheroidal space. The factored solution to the wave equation is given by, $$p = S(jh,\eta)R(jh)R(jh,-j\xi)\Phi(\phi) \qquad \text{Equation (7).}$$

where, S is the angular function, R is the radial function and $\Phi$ is the azimuthal function. The variable h ($h=\pi d/\lambda$) is a measure of the ratio of the focal distance d to the wavelength $\lambda$. The solution of Equation 6 when using the results of Equation 7 yields three ordinary differential equations. Using the Neumann boundary conditions (the normal velocity component is zero at the surface of the disk), the solution for the scattered field for plane-wave incidence at angle $\theta$ is, $$p_s = 2\sum_{m=0}^{\infty}\sum_{n=m}^{\infty}\epsilon_m \frac{j^n}{N_{mn}} \frac{R^{(1)\prime}_{mn}(jh,0)}{R^{(3)\prime}_{mn}(jh,0)} R^{(3)}_{mn}(jh,-j\xi) S_{mn}(jh,\cos\theta)S_{mn}(jh,\cos\eta)\cos(m\phi) \qquad \text{Equation 8.}$$

where $\epsilon$ is the Neumann symbol ($\epsilon_0=1$; $\epsilon_n=2$, for n=1, 2, 3, . . . ). The radial functions of the first and third kinds are indicated by the superscript in parentheses on the radial function R. The prime on the radial functions indicate the derivative with respect to the variable $\xi$. The variable $N_{mn}$ is a normalizing constant for the angular functions $S_{mn}$. The incident plane-wave field (unit amplitude) is, $$p_i = e^{-jk(x\sin\theta + z\cos\theta)} \qquad \text{Equation (9).}$$

The total acoustic pressure is the sum of the incident and scattered fields, $$p_t = p_i + p_s. \qquad \text{Equation (10).}$$

The total acoustic pressure was calculated using a computer program which solves Equation 10 for different positions above the circular disk baffle as a function of source incident angle, disk baffle size relative to the acoustic wavelength (h) and position. The geometry used in the computer program is similar to that shown in FIG. 1B and described in U.S. Pat. No. 4,965,775. Accordingly, the angle $\alpha$ was set to 0 degrees, and the infinite reflecting plane was replaced by a disk baffle of radius a. The radial position of the two-element array relative to the center is given by the variable r. Thus r/a is the ratio of the distance of the array along the disk baffle radius. The oblate angular and radial functions for different kinds and their derivatives were calculated using well known Fortran subroutines.

Two specific computational experiments were performed. The first investigated the effect of the circular disk baffle on the directional response of the microphone array similar to the one described in FIGS. 2A–2B. The second computational experiment was used to calculate the on-axis frequency response of the reflected second-order system. The experiments were performed in three locations over the disk baffle: the center, the midpoint between the center and the edge of the disk baffle, and the location at one-quarter of the radius from the edge of the disk baffle. The non-central locations were chosen to see what happens when the sensor is moved from the center of the disk baffle, since it is not always practical to locate the sensor over the center of the disk baffle.

Figure 5:
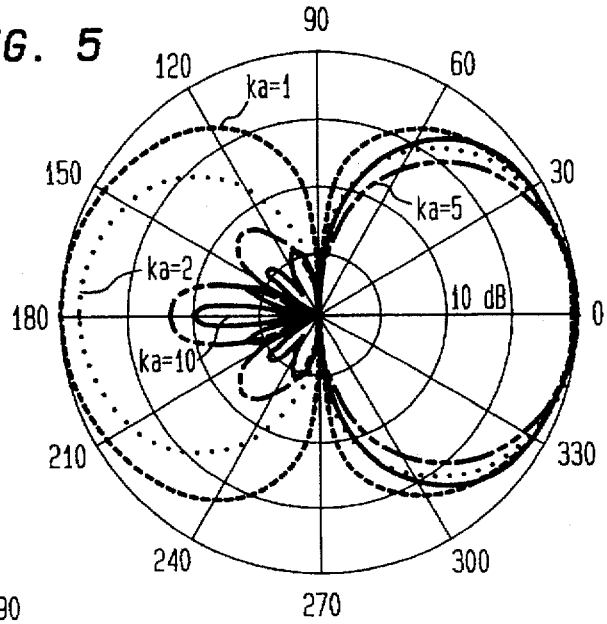
FIG. 5 graphically depicts the calculated directional responses of a two-element first order differential microphone array over the center of a circular disk finite baffle.
Figure 6:
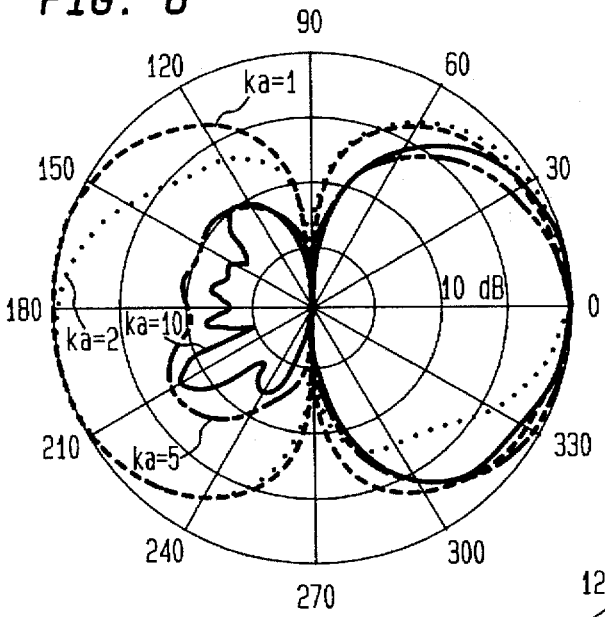
FIG. 6 graphically depicts the calculated directional responses of a two-element first order differential microphone array over a circular disk finite baffle at r/a=0.5.
Figure 7:
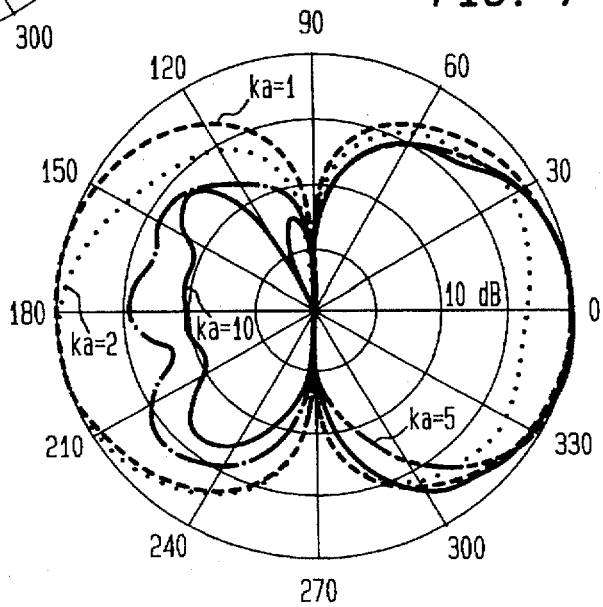
FIG. 7 graphically depicts the calculated directional responses of a two-element first order differential microphone array over a circular disk finite baffle at r/a=0.75.

FIGS. 5–7, depict the calculated directional responses for the microphone array, where the disk baffle has a radius a, the spacing between the sensors is 0.1 a and the nearest sensor is 0.1 a above the surface of the disk baffle. In particular, FIG. 5 depicts the calculated directional response when the microphone array of FIGS. 2A–2B is disposed over the center of the disk baffle for ka values of 1, 2, 5, and 10. FIG. 6, depicts the calculated directional response when the microphone array of FIGS. 2A–2B is disposed over the disk baffle at r/a=0.5 for ka values of 1, 2, 5, and 10. FIG. 7, depicts the calculated directional response when the microphone array of FIGS. 2A–2B is disposed over the disk baffle at r/a=0.75 for ka values of 1, 2, 5, and 10.

As can be seen from FIGS. 5–7, the directional response at ka=1.0 (and for values of ka<1) for the three locations along the disk baffle radius demonstrate that the disk baffle has little effect on the cosine response of a bidirectional first-order directional sensor. As ka increases beyond a value of 2.0, the directional response in the front-half plane is close to that of a first-order directional sensor array over an infinite baffle, as shown in FIG. 1C and discussed in U.S. Pat. No. 4,965,775. The beamwidth, however, widens as the sensor is moved towards the edge of the disk baffle. Furthermore, the rear rejection diminishes as the sensor array is moved toward the edge of the disk baffle. For this reason, it is preferred that the sensor array be oriented over the center or as close as possible to the center of the disk baffle.

Figure 8:
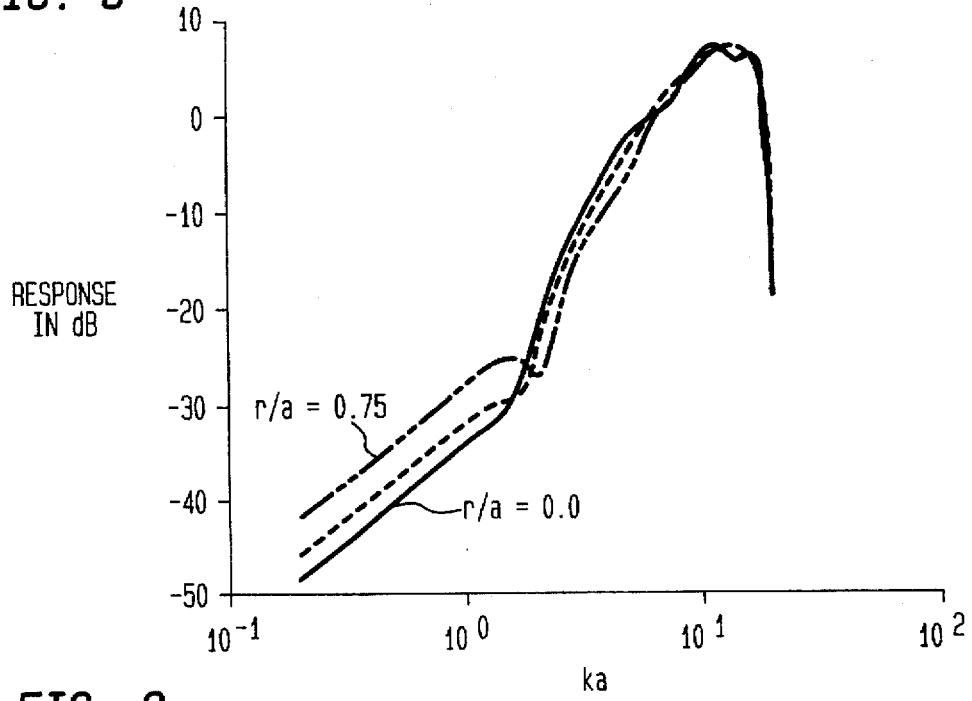
FIG. 8 graphically depicts the calculated frequency responses of a two-element first order differential microphone array over a circular disk finite baffle at r/a=0.0, 0.5 and 0.75.

Another way to observe the transition of the array from a low-frequency first-order behavior to a second-order response is to examine the calculated frequency response. The response for a free-field first-order dipole rises at 6 dB/octave. For a second-order dipole the frequency response increases at 12 dB/octave. By examining the response, it is possible to see where the transition from 6 dB/octave to 12 dB/octave occurs. In FIG. 8, the frequency responses at three locations: r/a=0.0, r/a=0.5, and r/a=0.75 along the disk baffle radius a for normal incident sound ($\theta$=0°) are shown. As stated earlier, the spacing between the elements is equal to 0.1 a and the nearest element is 0.1 a from the disk baffle surface.

The zero at the upper value of ka is the first zero in the response due to the acoustic pressure-difference approaching the first null for spacings or frequencies where ka≈20 for this array configuration. At lower values of ka it can be seen that the response approaches the expected 6 dB/octave of a first-order differential microphone. The transition from first to second-order for normal incidence, occurs at approximately ka=1.5. For ka<1.5, the sensitivity of the array is lower as the array is moved towards the center. The decrease in sensitivity as the array is moved towards the center is most likely due the image being stronger as the array moves towards the center. A stronger image results in a response that is more second-order and thus, lower in sensitivity even though the directional patterns are close to that of a dipole for low values of ka. Moreover, the actual transition frequency moves up as the array is moved towards the edge of the disk baffle. The bend or "knee" observed in the curve for the value of r/a=0.75 correlates to the observation that the directivity patterns do not have a maximum at the value of n=1 in the region of ka=2 (a value where the circumference of the disk is equal to two wavelengths) as shown in FIG. 7. The transition region from first to second-order becomes larger as the array is moved toward the edge of the disk baffle. The directivity function in this transition region varies significantly. Another feature that can be easily observed in the FIGS. 5–7 is that the beamwidth increases and the pattern approaches that of a dipole for high values of ka as the array is moved out towards the edge of the disk baffle and further, the beamwidth reduction is not monotonic in frequency. For instance, the beamwidth at the value of ka=10 is larger than the beamwidth at ka=5 for each measurement position shown. This result is due to the selection of the spacing that is used for the elements. As the frequency increases beyond ka>5, the response approaches a zero as previously mentioned. The apparent widening of the array is due to the proximity of the zero which flattens out the directional response for an on-axis signal. As a result, the beamwidths for values of ka>5 appear to be wider that for ka=5. If a smaller spacing were chosen for the two elements, then the beam-shape would stabilize at larger ka near the predicted $\cos^2\theta$ for an infinite reflecting plane. Finally, the directivity functions are non-asymmetric for all but the central location. The beam-shape shows a more cosine-squared response in the directions where the wave propagates over a larger area of the disk baffle before impinging on the array. This type of behavior is well known in the art for second-order directional microphones that are mounted parallel to a finite table-top surface.

In order to support the calculations and determine the accuracy of the above-described solutions in predicting the actual fields measured for a disk baffle of finite thickness, image-derived second-order differential microphones made in accordance with the present invention were built. One microphone employed a 12 inch diameter, ⅜ inch thick steel plate baffle. Another microphone employed a rectangular steel plate baffle having the dimensions of 11"×14.5" and ¼" thick. The microphone with the rectangular steel plate baffle was measured to determine whether the general results predicted for the disk baffle are applicable to other more complicated geometries. Moreover, image-derived microphones employing rectangular plate baffles are applicable to standard computer terminals for acoustic input to computers.

While the experimental results were derived using a steel plate, any acoustically reflecting plate can be utilized. One such example is the plastic bezel surrounding a computer monitor which can function as a baffle.

The experimental measurements made on the image-derived microphone with the 12" diameter×⅜" thick steel circular disk baffle included two phase-matched microphones marketed by Bruel & Kjaer under the model no. 4183. Such microphones are typically used for the measurement of acoustic intensity. The amplitude and phase matching of the microphones was sufficient over the frequency range that was used to measure the directivity patterns and frequency responses. The microphones were spaced 1.5 cm apart from each other and the nearest microphone was placed at a distance of 2 cm from the disk baffle surface. Three measurement positions were investigated for both the directional responses at varying frequencies (0.5–4 kHz in 0.5 kHz steps) and for frequency response measurements. These positions were: r/a=0.0 (center of the disk baffle), r/a=0.5, and r/a=0.75.

Figure 9:
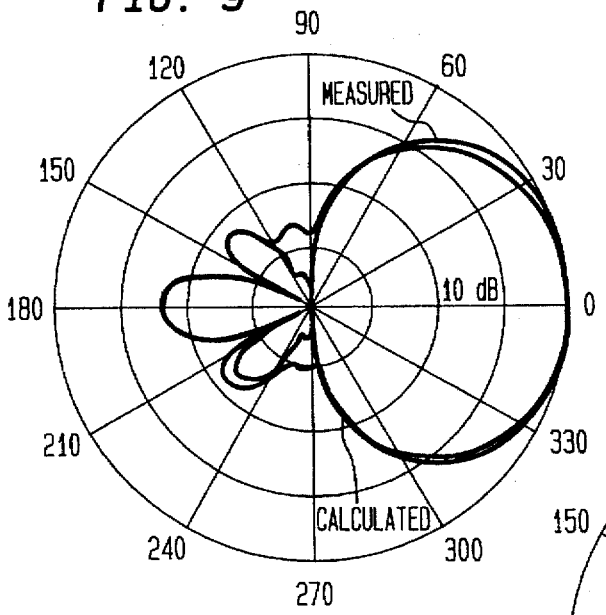
FIG. 9 graphically depicts measured and calculated directional responses for the image-derived second-order microphone of the present invention at r/a=0.0 for 2 kHz.
Figure 10:
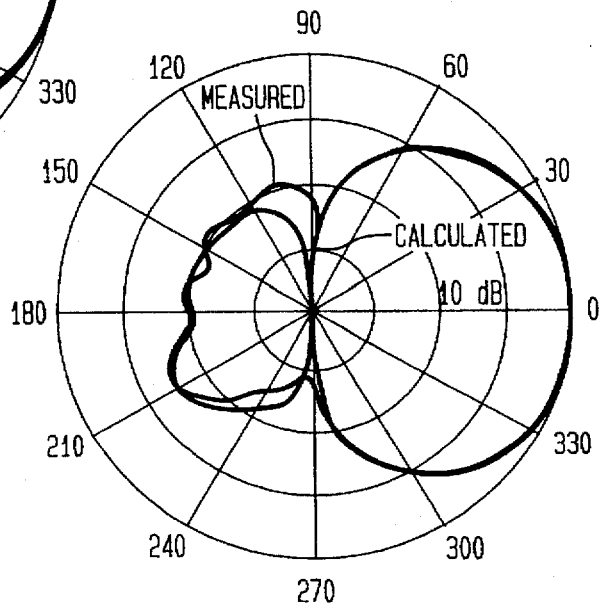
FIG. 10 graphically depicts measured and calculated directional responses for the image-derived second-order microphone of the present invention at r/a=0.5 for 2 kHz.
Figure 11:
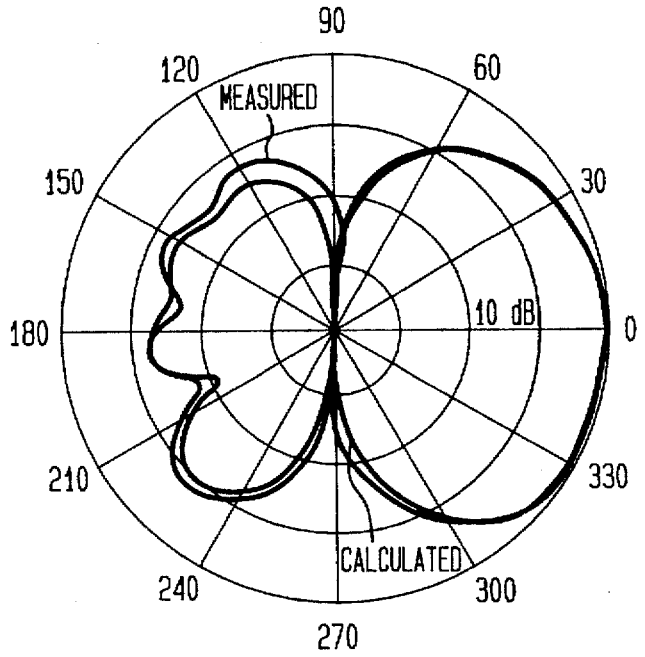
FIG. 11 graphically depicts measured and calculated directional responses for the image-derived second-order microphone of the present invention at r/a=0.75 for 2 kHz.

In FIGS. 9–11, the actual measured and calculated directional responses are compared at 2 kHz at the three measurement locations for the image-derived microphone with the 12" diameter×⅜" thick steel circular disk baffle. FIG. 9 in particular, compares the measured and calculated directional responses at r/a=0.0. In FIG. 10 the measured and calculated directional responses are compared at r/a=0.5 and in FIG. 11, the measured and calculated directional responses are compared at r/a=0.75. As can be observed from FIGS. 9–11, the measured directional responses generally agree with the calculated responses discussed earlier. The minor differences seen are probably due to the slight amplitude and phase distortions from the measurement microphones. Also, the measurement microphones integrate over a ½" area whereas the calculated results use a point receiving microphone. This effect has not been precisely quantified, but since the size of the microphone elements is substantially smaller than the acoustic wavelength, it is expected that the effect is small. Measurements obtained at other frequencies (not shown) show similar agreement.

Figure 12:
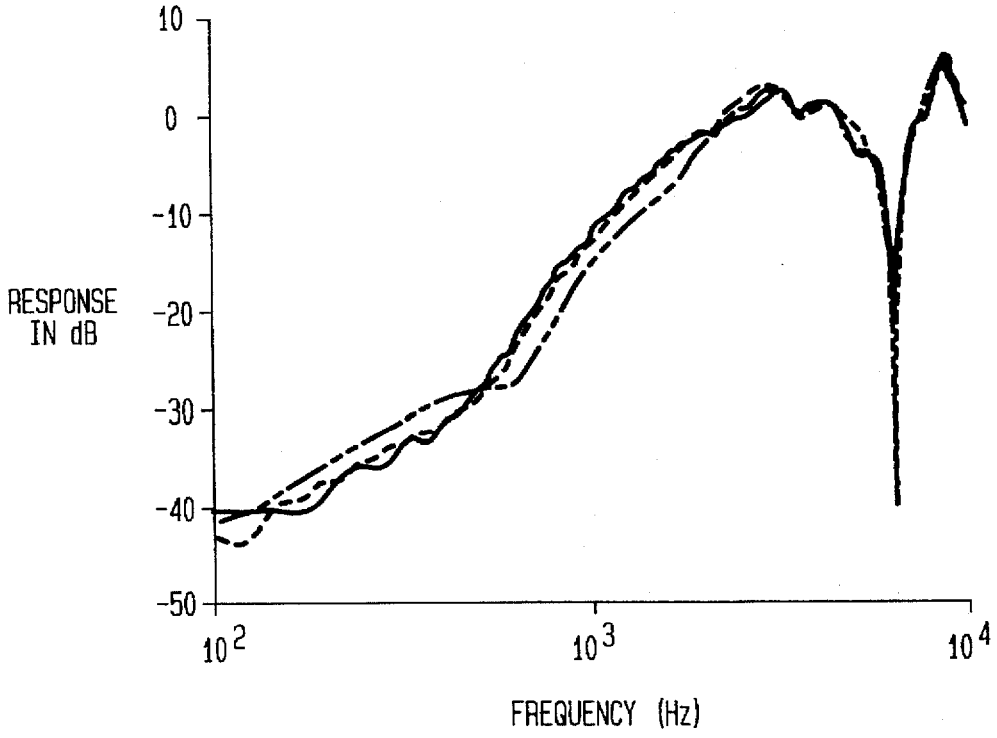
FIG. 12 graphically depicts the measured frequency responses of a two-element first order differential microphone array over a circular disk finite baffle at r/a=0.0, 0.5 and 0.75.

In FIG. 12, the measured frequency response of the image-derived second-order microphone employing the 12" diameter×⅜" thick steel circular disk baffle is shown. The solid line represents the response of the microphone array when positioned at the center of the disk baffle. The dashed line represents the response of the microphone array when positioned at r/a=0.5 and the dash-dot line represents the response of the microphone array when positioned at r/a=0.75. The transition from first to second-order occurs at approximately 500 Hz. This value corresponds to a value of ka≈1.4 and is substantially similar to the previously observed transition ka for a centrally located array as shown in FIG. 8. It can also be seen in FIG. 12, that the transition region becomes wider in bandwidth as the microphone array is moved towards the edge of the disk baffle. This was also observed in the calculated responses. The zero at 6.4 kHz in the measured response is due to the distance of the microphone array from the reflecting surface of the disk baffle. Theoretically, the first zero in the response for the two-element array should occur when the distance between the center of the microphone array and the finite reflecting plane is equal to one-half of the acoustic wavelength. The distance from the center of the microphone elements to the reflecting surface of the 12" diameter×⅜" thick disk baffle was 2.75 cm. This distance corresponds to one-half a wavelength at approximately 6.2 kHz; a value that is very close to the zero that can be seen in FIG. 12. The zero location can be moved to higher frequencies by moving the array closer to the reflecting plane of the disk baffle, however, the added usable bandwidth results in a commensurate loss in array sensitivity or, equivalently, the signal-to-noise ratio. Accordingly, the preferred spacing between the array and the reflecting plane of the disk baffle is set such that the first-zero falls just outside the upper frequency design requirement. Alternatively, in order to increase acoustic sensitivity, pressure-differential microphone elements which employ sensor baffles such as shown in FIG. 2A can be utilized.

The experimental measurements made on the image-derived microphone with the 11"×14.5"×¼" rectangular steel plate baffle will now be described. The plate baffle was viscoelastically damped by applying a conventional acoustical damping material on the opposite side on which the array is mounted over. This was required since the undamped plate baffle could be easily excited acoustically and the decay was very slow (on the order of seconds). With the application of an acoustic damping material, the plate "ringing" was removed. Furthermore, it is well known that subsonic-speed bending waves in plates baffles cause large evanescent wave fields (non-propagating sound field that is in the acoustic near-field of the plate) near the surface that easily "couple" into differential microphones. Therefore, care must be taken in selecting the finite baffles on which the differential microphones are to be mounted over.

Similar types of directional and frequency response measurements were made on the rectangular baffle as were made on the circular disk baffle. The measurement locations were: x/a=0.0 (center), 0.5, 0.75, and 0.875. The variable x is the coordinate along the plate length. The coordinate axes is centered at the plate center, "a" is one-half the plate baffle length (a=7.25" for the results presented here), and the plate baffle width is 2 b (b=5.5").

Figure 13:
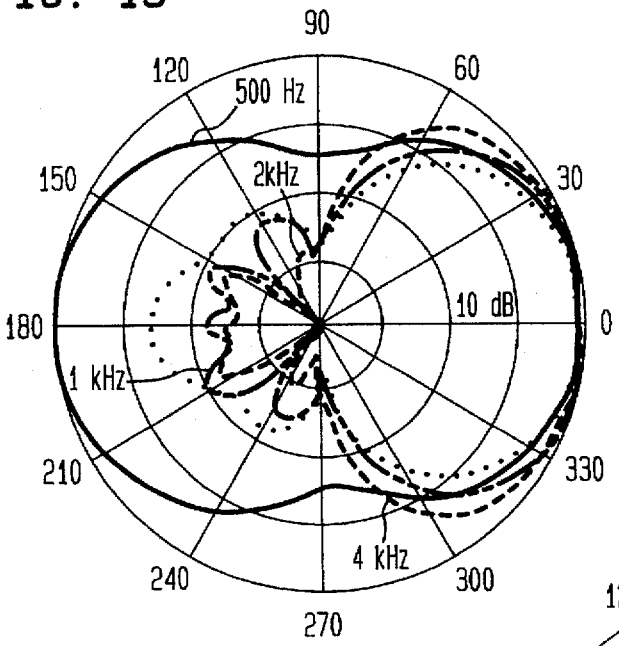
FIG. 13 graphically depicts the measured directivity patterns for the image-derived second-order microphone over a rectangular plate at x/a=0.0 for 0.5, 1, 2, and 4 kHz.
Figure 14:
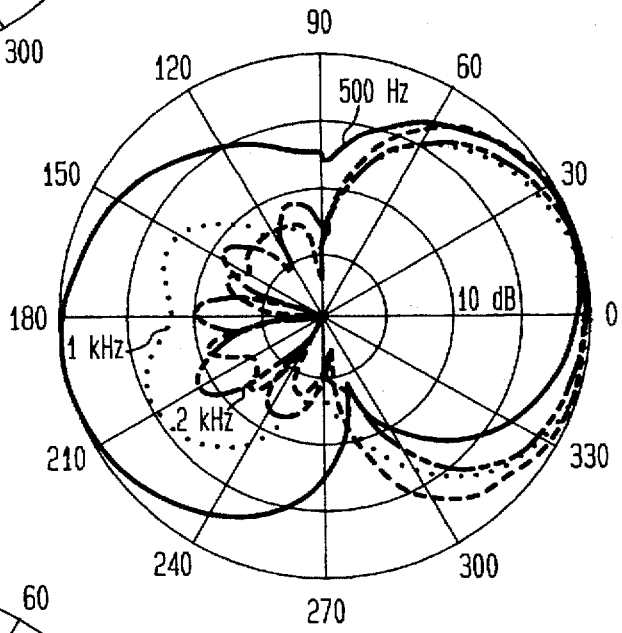
FIG. 14 graphically depicts the measured directivity patterns for the image-derived second-order microphone over a rectangular plate at x/a=0.5 for 0.5, 1, 2, and 4 kHz.
Figure 15:
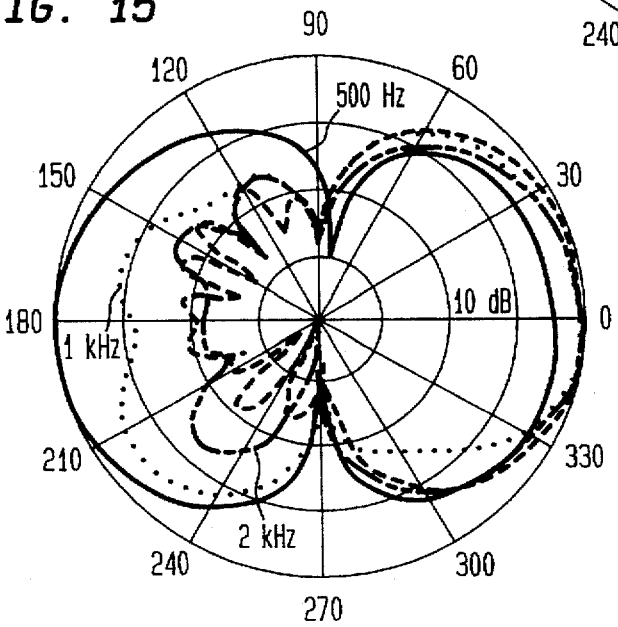
FIG. 15 graphically depicts the measured directivity patterns for the image-derived second-order microphone over a rectangular plate at x/a=0.75 for 0.5, 1, 2, and 4 kHz.
Figure 16:
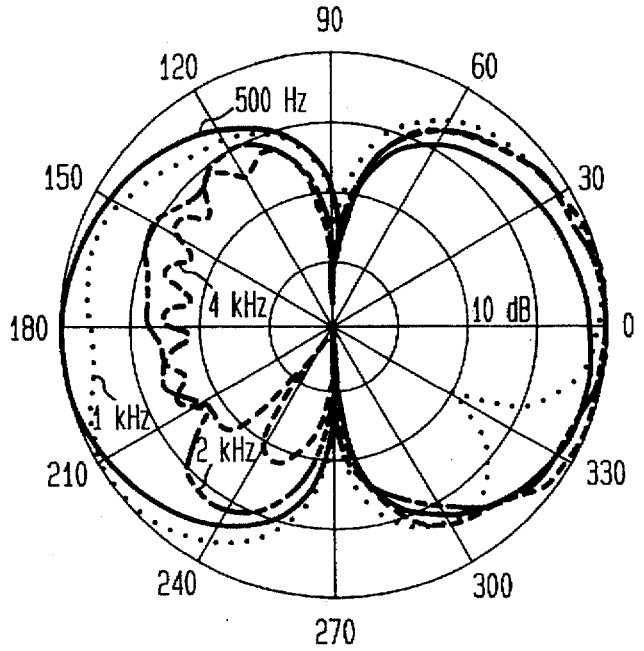
FIG. 16 graphically depicts the measured directivity patterns for the image-derived second-order microphone over a rectangular plate at x/a=0.875 for 0.5, 1, 2, and 4 kHz.

In FIGS. 13–16, the measured directional responses for the image-derived microphone with rectangular baffle at the four measurement locations at the frequencies of: 0.5, 1,2, and 4 kHz are shown. In particular, FIG. 13 shows the measured directivity patterns for x/a=0.0 (center) for 0.5, 1, 2, and 4 kHz; FIG. 14 shows the measured directivity patterns for x/a=0.5 for 0.5, 1, 2, and 4 kHz; FIG. 15 shows the measured directivity patterns for x/a=0.75 for 0.5, 1, 2, and 4 kHz; and FIG. 16 shows the measured directivity patterns for x/a=0.875 for 0.5, 1, 2, and 4 kHz. As can be seen, the patterns are first-order dipole at low frequencies which then converge toward a second-order dipole ($\cos^2\theta$) at higher frequencies. These patterns are similar to what was observed in the circular disk baffle calculations and measurements. As the microphone array is moved towards the edge rectangular plate baffle, it can be seen that the directivity patterns become very unsymmetrical. In the vicinity of 1 kHz (ka≈3 and kb≈1), the pattern deviates significantly from either a first-order dipole or second-order dipole directional response.

Figure 17:
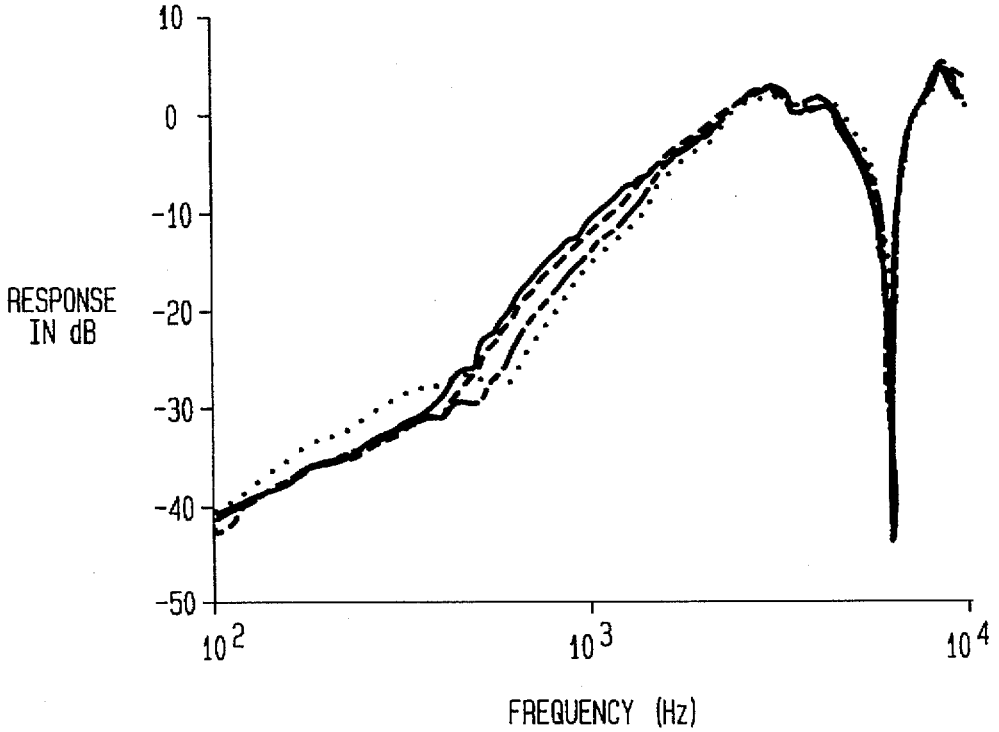
FIG. 17 graphically depicts the measured frequency responses of a two-element first order differential microphone array over a rectangular plate finite baffle at x/a=0.0, 0.5, 0.75, and 0.875.

In FIG. 17, the measured frequency responses of the image-derived second order differential microphone having the rectangular plate baffle are shown. The responses have been plotted at the four measurement locations used in the directional response measurements presented in regard to the circular disk baffle. The results have strong similarities to those given for the circular disk baffle. More specifically, the microphone array has first-order response frequencies where the baffle is small compared to the acoustic wavelength and approaches second-order (12 dB/octave) response at higher frequencies. As the microphone array is moved towards the edge plate baffle, the transition frequency from first to second-order moves up and the transition region becomes larger. The zero in the response at just over 6 kHz is due to the spacing of the microphone sensors relative to the plate baffle as earlier explained with the circular disk baffle.

The results presented above indicate for an image-derived microphone over a finite baffle, that largest possible baffle is most desirable when choosing the baffle dimensions. It has also been shown that it is preferred to position the image-derived sensor is at the center of the finite baffle, or equivalently, as far as possible from the bounding edges. In addition, the baffle size should be on the order of a one-half a wavelength or preferably larger to attain a second-order response. Finally, it should be noted that the physical phenomena of the higher directivity for receiving differential microphones over a reflecting plane is directly applicable to transmitting loudspeakers.

One of the problems with higher-order differential microphones is that the SNR decreases with $1/(f^n)$ where n is the differential order and f is the frequency. Therefore at low frequencies the output falls off and-the signal moves into the noise floor. The image-derived microphone has the advantage that on a finite baffle the microphone reverts to a first-order microphone and thus does not suffer as great a SNR problem at low frequencies as with a second-order microphone. Thus, what at first appears to be a limitation is an advantage if some directivity is sacrificed for the microphone.

It should be understood that the embodiments described herein are merely exemplary and that a person skilled in the art may make many variations and modifications to the embodiments utilizing functionally equivalent elements to those described herein. Any and all such variations or modifications as well as others which may become apparent to those skilled in the art, are intended to be included within the scope of the invention as defined by the appended claims.

What is claimed is:

1. An acoustic transducer comprising:

an acoustical reflecting surface of a finite dimension, said finite dimension being approximately one to one-half of an acoustic wavelength at a predetermined frequency; and at least one sensor having an output which produces a first-order differential response pattern, said at least one sensor being located proximate to said reflecting surface, wherein acoustical waves propagating from said reflecting surface, acoustically interact with said at least one sensor to produce a second-order differential response at said output of said at least one sensor at said predetermined frequency and at low frequencies relative to said predetermined frequency a first-order response at said output occurs.

2. The acoustic transducer according to claim 1, wherein said at least one sensor is located over a substantially central region of said reflecting surface.

3. The acoustic transducer according to claim 1, wherein said reflecting surface is defined by a substantially circular disk of said finite dimension.

4. The acoustic transducer according to claim 1, wherein said second-order differential response pattern at said output of said at least one sensor occurs at said predetermined frequency when said finite dimension of said reflecting surface is at least one-half of an acoustic wavelength.

5. The acoustic transducer according to claim 1, wherein said reflecting surface is defined by a substantially rectangular ridged reflecting plate of said finite dimension.

6. The acoustic transducer according to claim 1, wherein said at least one sensor includes two spaced apart sensors which form an array.

7. The acoustic transducer according to claim 1, wherein said at least one sensor includes a plurality of spaced apart sensors which form an array.

8. The acoustic transducer according to claim 1, wherein said reflecting surface includes two intersecting reflecting surfaces, each of said reflecting surfaces having a finite dimension, said at least one sensor being located proximate to an edge of said two intersecting reflecting surfaces.

9. The acoustic transducer according to claim 8, wherein said at least one sensor includes a plurality of spaced sensors which form an array.

10. The acoustic transducer according to claim 1, wherein said second-order differential response pattern is substantially unidirectional.

11. The acoustic transducer according to claim 1, wherein said second-order differential response pattern is substantially toroidal.

12. The acoustic transducer according to claim 1, wherein said at least one sensor is located over and spaced a predetermined distance from said reflecting surface.

13. A second-order differential image-derived microphone comprising:

a baffle having an acoustical reflecting surface of a finite dimension; and at least one microphone having an output which produces a first-order differential response pattern, said at least one microphone being located proximate to said reflecting surface of said baffle, wherein acoustical waves propagating from said reflecting surface, acoustically interact with said at least one microphone to produce a second-order differential response pattern at said output at a frequency where said finite dimension of said reflecting surface is approximately one to one-half of an acoustical wavelength.

14. A second-order differential image-derived microphone according to claim 13, wherein said finite dimension being derived from, $a=\frac{1}{2}k$, where a is said finite dimension of said reflecting surface and k is an acoustic wavenumber corresponding to a frequency where said output of said at least one microphone produces said second-order differential response pattern.

15. The image-derived microphone according to claim 13, wherein said at least one microphone is located over a substantially central region of said baffle.

16. The image-derived microphone according to claim 13, wherein said baffle is substantially circular in shape.

17. The image-derived microphone according to claim 13, wherein said baffle is substantially rectangular in shape.

18. The image-derived microphone according to claim 13, wherein said at least one microphone includes a plurality of spaced apart microphones which form an array.

19. The image-derived microphone according to claim 13, further comprising a second baffle having at least one reflecting surface of a finite dimension, said at least one microphone being located proximate to an edge where said baffles intersect.

20. The image-derived microphone according to claim 19, wherein the directivity of said at least one microphone along an orthogonal axis thereof, varies in response to changing an angle at which said baffles intersect.

21. The image-derived microphone according to claim 13, wherein said second-order differential response pattern is substantially unidirectional.

22. The image-derived microphone according to claim 13, wherein said second-order differential response pattern is substantially toroidal.

* * * * *